United States Patent [19]

Kramers

[11] Patent Number: 4,467,595

[45] Date of Patent: Aug. 28, 1984

[54] LATENT CONTRACTABLE ELASTOMERS, COMPOSITE YARNS THEREFROM AND METHODS OF FORMATION AND USE

[75] Inventor: Aloysius A. J. Kramers, Asheville, N.C.

[73] Assignee: Akzona Incorporated, Asheville, N.C.

[21] Appl. No.: 532,338

[22] Filed: Sep. 14, 1983

Related U.S. Application Data

[63] Continuation of Ser. No. 313,927, Oct. 22, 1981, abandoned, which is a continuation-in-part of Ser. No. 178,661, Aug. 18, 1980, abandoned.

[51] Int. Cl.[3] ..... D02G 3/02

[52] U.S. Cl. ..... 57/225; 264/176 F; 528/272; 528/289

[58] Field of Search ..... 264/176 F, 342 RE, 210.8; 528/283, 289, 272; 57/207, 228, 226, 908; 428/230; 28/156

[56] References Cited

U.S. PATENT DOCUMENTS

| | | | |
|---|---|---|---|
| 3,013,379 | 12/1961 | Breen | 57/226 |
| 3,234,725 | 2/1966 | Storti | 57/163 |
| 3,357,076 | 12/1967 | Greenwald et al. | 264/DIG. 77 |
| 3,357,954 | 12/1967 | Kirkaldy | 528/83 |
| 3,377,415 | 4/1968 | Oppenlander | 264/342 RE |
| 3,408,435 | 10/1968 | Logan, Jr. et al. | 264/210 |
| 3,412,547 | 11/1968 | Martin | 57/226 |
| 3,432,590 | 3/1969 | Papps | 264/342 RE |
| 3,476,850 | 4/1969 | Matsubayashi et al. | 264/205 |
| 3,537,803 | 10/1970 | Epstein et al. | 264/210 |
| 3,609,953 | 10/1971 | Kitazawa | 57/226 |
| 3,679,633 | 7/1972 | Matsubayashi et al. | 264/210.8 |
| 3,896,078 | 7/1975 | Hoeschele | 528/301 |
| 3,927,167 | 12/1975 | Reese | 264/210.8 |
| 3,937,755 | 2/1976 | Hahn et al. | 528/301 |
| 3,998,921 | 12/1976 | Kohler et al. | 264/210 F |
| 4,262,114 | 4/1981 | Wagener et al. | 528/301 |

FOREIGN PATENT DOCUMENTS

| | | | |
|---|---|---|---|
| 657774 | 2/1963 | Canada . | |
| 761720 | 6/1967 | Canada . | |
| 784813 | 5/1968 | Canada . | |
| 1961004 | 6/1970 | Fed. Rep. of Germany . | |
| 43-7426 | 3/1968 | Japan . | |
| 44-20478 | 9/1969 | Japan | 528/289 |
| 45-2192 | 1/1970 | Japan | 528/289 |
| 711279 | 6/1954 | United Kingdom . | |
| 996874 | 6/1965 | United Kingdom . | |
| 1091422 | 11/1967 | United Kingdom . | |
| 1282745 | 7/1972 | United Kingdom . | |

*Primary Examiner*—Jay H. Woo

*Attorney, Agent, or Firm*—David M. Carter; Jack H. Hall; Francis W. Young

[57] ABSTRACT

This invention relates to melt extruded latent contractable elastic filaments which are formed by melt extruding certain segmented crosslinked thermoplastic polymers to form filaments, which filaments, when heat processed at elevated temperatures, significantly contract to yield an elastic filament. This invention also relates to the formation of composite covered yarn comprising said latent contractable melt extruded filaments. In addition, this invention relates to processes for forming articles from said latent contractable filaments or covered yarns comprising said contractable filaments and subsequently contracting said yarns to form an elastic article.

14 Claims, 7 Drawing Figures

LATENT CONTRACTABLE ELASTOMERS, COMPOSITE YARNS THEREFROM AND METHODS OF FORMATION AND USE

CROSS REFERENCE TO RELATED APPLICATION

This is a continuation of application Ser. No. 313,927, filed Oct. 22, 1981, now abandoned, which is a continuation-in-part of application Ser. No. 178,661 filed Aug. 18, 1980, now abandoned.

BACKGROUND OF THE INVENTION

Elastic yarns, notably spandex yarns, are frequently used in a variety of woven and knitted articles, especially garments, to enhance fit, comfort, and/or to provide compression support. The use of such yarns is relatively expensive, not only because of the cost of the fiber, but also because in order to obtain the maximum benefits of the elastic properties of the yarn, the yarn must be woven or knitted in a stretched condition requiring specially adapted machinery which operates at processing speeds less than those employed with conventional non-elastic yarns.

In contrast, the yarns of the invention can be processed in a non-stretched mode, as a conventional yarn, and when formed into a processed, e.g., woven, knitted or tufted article, can be contracted to provide an elastic article.

Composite yarns comprising elastic yarns and a covering of entangled relatively inelastic filaments are taught in U.S. Pat. No. 3,940,917. These yarns are formed by conducting the entangling step when the elastic yarn is in a stretched condition.

DESCRIPTION OF THE INVENTION

Figure 1:
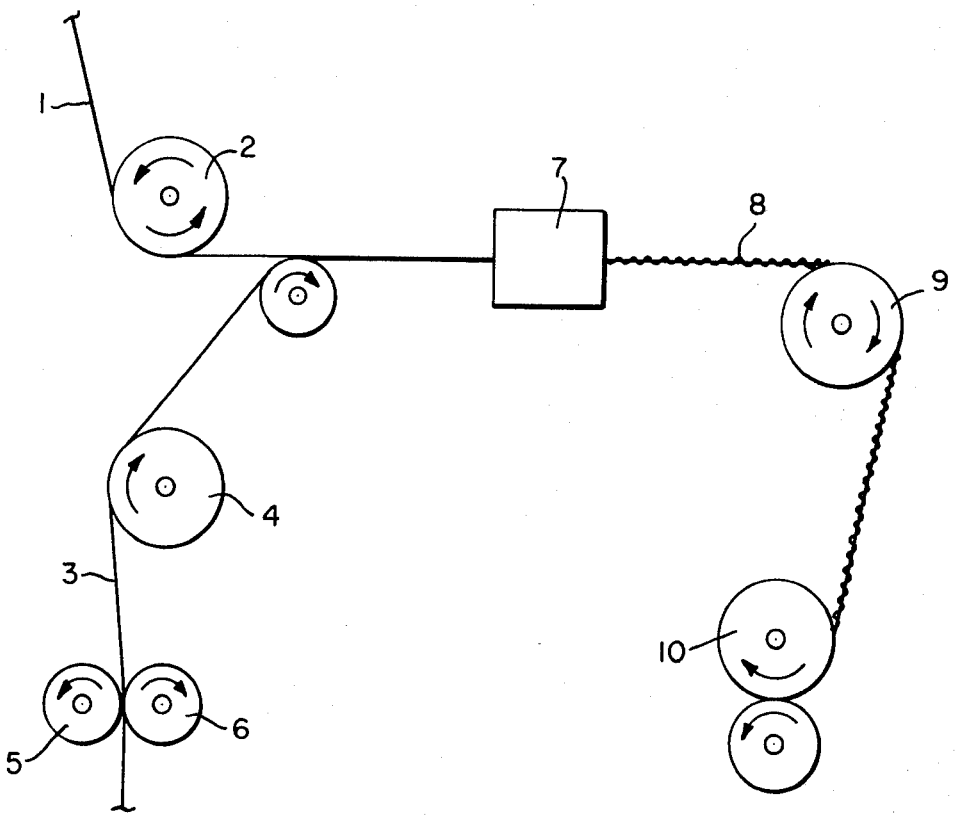
FIG. 1 is a schematic representation of a process for entangling a hard fiber yarn about an uncontracted melt extruded filament of the invention.

This invention relates to melt extruded latent contractable filaments which are formed by melt extruding certain segmented physically crosslinked thermoplastic polymers to form filaments, which filaments, when heat processed at elevated temperatures, significantly contract to yield an elastic filament. This invention also relates to the formation of composite covered yarn comprising said latent contractable melt extruded filaments. In addition, this invention relates to processes for forming articles from said latent contractable filaments or covered yarns and subsequently contracting said yarns to form an elastic article.

The latent contractable filaments of this invention are formed by melt extrusion of certain segmented, crosslinked thermoplastic polymers, which, when in an elastic state, display a relatively hard or crystalline segment and a relatively amorphous soft segment. While not intending to be bound by any theory, it is believed that during melt extrusion, the ordinarily relatively unoriented soft segment is oriented, at least to some degree, followed by cooling, which fixes the filament in a relatively oriented state. Subsequently, as hereinafter described, when the filament is subjected to heat processing at an elevated temperature, the orientation of the soft segment created by the melt extrusion is dissipated, causing contraction of the filament and the creation of substantially increased elastic properties in the filament.

The polymers, which can be employed in the yarns and processes of the invention, include virtually any physically crosslinked polymer containing interspersed relatively soft and relatively hard segments which, when melt extruded into a filament and solidified and then subjected to heat, contracts at least 25% in length compared to its extruded length to provide an elastic filament.

It is believed that the polymers which can be employed are polymers consisting of a hard segment and a soft segment capable of forming one phase in the melt, which yield a poorly phase separated morphology when quenched and that, upon latent contraction by a heat treatment, produce a well phase separated morphology.

A particularly useful class of elastomers are described in U.S. Pat. No. 4,262,114, which is hereby incorporated by reference in its entirety. These elastomers comprise thermoplastic segmented copolyester polyethers, consisting essentially of a multiplicity of randomly occurring intrachain segments of long-chain (soft segments) and short-chain (hard segments) ester units, said long-chain ester units being represented by the following structure:

$$-\mathrm{OLO}-\overset{\overset{\mathrm{O}}{\|}}{\mathrm{C}}-\mathrm{R}-\overset{\overset{\mathrm{O}}{\|}}{\mathrm{C}}- \qquad \text{(a)}$$

where L is a divalent radical remaining after removal of terminal hydroxyl groups from poly (oxyalkylene) glycols having at least 1 nitrogen containing ring per molecule, a carbon to nitrogen ratio of from about 3/1 to about 350/1, and a molecular weight between 200 and 8,000, and R is a divalent radical remaining after the removal of the carboxyl groups from a dicarboxylic acid having a molecular weight of less than 300.

Short-chain ester units are represented by the following structure:

$$-\mathrm{OEO}-\overset{\overset{\mathrm{O}}{\|}}{\mathrm{C}}-\mathrm{R}-\overset{\overset{\mathrm{O}}{\|}}{\mathrm{C}}- \qquad \text{(b)}$$

where E is a divalent radical remaining after removal of hydroxyl groups from a low molecular weight diol having 2 to 15 carbon atoms per molecule and a molecular weight between 50 and 250, and R is the divalent radical described for (a) above.

The introduction of a foreign repeat unit in the backbone of a crystallizable soft segment, such as a polyether, has an effect on the soft segment crystallization process. Such a foreign unit must be stable to processing temperatures and must not be so rigid as to reduce the mobility (raise the glass transition temperature) of the soft segment itself. The foregoing unit should be nonreactive during the synthesis of the segmented thermoplastic elastomer, and should be present in the concentration of at least 1 unit per polyether molecule.

The polyether unit (or —OLO— in formula (a) above) of the soft segment may be represented by the following structures, in which the foreign repeat unit X is alkoxylated:

$$(OCH_2CH_2)_mX(CH_2CH_2O) \quad (c)$$

or $$\text{-}[(OCH_2CH_2)_m X(CH_2CH_2O)_n CH_2CH_2\text{-}X\text{-}CH_2CH_2]_x O\text{-} \quad (d)$$

In (c), the unit X is placed near the center of the polyether chain, and may be one foreign unit or a series of foreign units covalently linked together. In (d), the unit X is one or more foreign repeat units as in (c), but these units are placed along the length of the linear polyether chain.

In both formulas (c) and (d), X is a nitrogen containing heterocyclic ring, giving the polyether soft segment a carbon to nitrogen ratio of from about 3/1 to about 350/1, and a molecular weight between 200 and 8,000. The sum of m plus n is within the range of 5 to 180, and x in formula (d) has a maximum value of 10.

The nature of X is such that it may covalently enter the polyether chain to influence crystallization. Covalent links to the polyether in (c) or (d) may be the amide link or the imide link, both of which are capable of withstanding high temperature processing. These links, the polyester units themselves, and the foreign unit(s) X in (c) or (d) form the soft segment.

The introduction of the repeat unit X into the poly(oxyethylene) chain, where X is greatly different from poly(oxyethylene), disrupts chain regularity and suppresses the melting point of the soft segment, preventing crystallization at room temperature. This allows the use of higher molecular weight polyethers, or stated differently, lower mole percentage of the soft segment. The lower mole percentage of soft segment increases the melting point of the copolymer due to higher mole percentage of the hard segment. Also, a more regular chain is obtained, which may result in better separation of the hard and soft phases. Better phase separation results in a higher tenacity, a lower glass transition temperature for the soft segment, and an improved elastomeric performance.

The term "foreign repeat unit" as applied to the soft segments refers to heterocyclic, nitrogen-containing rings which may covalently link (as amide or imide) along the soft segment chain as described previously. Representative units are: 1,3-divalent-5,5-dialkylhydantoin (including alkyl groups connected in a cyclic fashion to the 5,5 positions); 2,5-divalent-1,3,4-triazole; 2,5-divalent-1,3-4-oxadiozole; 2,-5-divalent-1,3,4-thiadiazole; 1,3-divalent-1,2,4-triazolidine-3,5-dione; 4,5-divalent-1,2-isothiazole, 4,5-divalent-1,2-oxazole, 4,5-divalent-1,3-diazole; 2,5-divalent-1,3-oxazole; 2,4-divalent-imidazole; divalent (N position) hypoxanthine; and 2,5-divalent-1,3-thiazole. A preferred unit is 5,5-dialkyl hydantoin having the following formula:

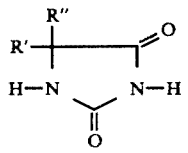

wherein R' and R'' are lower alkyl, e.g., methyl, ethyl, propyl, which can be converted to a polyoxyalkylene glycol represented by (e) or (f) by oxyalkylation with ethylene oxide as disclosed in the above mentioned U.S. Pat. No. 4,262,114.

The term "long-chain ester units" as applied to units in the copolymer chain refers to the reaction product of a long chain glycol with a dicarboxylic acid. Such "long-chain ester units", which is selected from repeating units in the copolyesters of this invention, correspond to formula (a) above. The long-chain glycol are polymeric glycols having terminal hydroxy groups and a molecular weight above about 400 and preferably about 1,000 to 3,000 for (c). The long-chain glycol used to prepare the copolyesters of this invention are poly(oxyalkylene) glycols having foreign repeat units represented by formulas (e) and (f).

$$H(OCH_2CH_2)_mX(CH_2CH_2O)_nH \quad (e)$$

$$H[(OCH_2CH_2)_mX(CH_2CH_2O)_nCH_2CH_2\text{-}X\text{-}CH_2CH_2]_xOH \quad (f)$$

The poly(oxyalkylene) glycols have carbon to nitrogen ratios between about 3/1 and about 350/1, molecular weights between 200 and 8,000, m plus n is within the range of 5 to 180, and x in formula (f) has a maximum value of 10. In a preferred embodiment, the poly(oxyalkylene) glycols have carbon to nitrogen ratios between about 8.5/1 and about 23/1 and molecular weights between 450 and 8,000. Representative long-chain glycols are poly(oxyethylene) glycol, poly(oxypropylene) glycol, poly(oxymethylethylene) glycol, poly(oxytetramethylene) glycol, and random or block copolymers of ethylene oxide and 1,2-propylene oxide.

The term "short-chain ester units" as applied to units in the copolymer chain refers to low molecular weight compounds for polymer chain units having molecular weights less than about 500. They are made by reacting a low molecular weight diol (below about 250) with a dicarboxylic acid to form ester units represented by formula (b) above.

Included among the low molecular weight diols which react to form the short-chain ester units are a cyclic, alicyclic, and aromatic dihydroxy compounds. Preferred are diols with 2 to 15 carbon atoms, such as ethylene, propylene, 1,4-butane, pentamethylene, 2,2-dimethyl trimethylene, hexamethylene, and decamethylene glycol, dihydroxycyclohexane, cyclohexane dimethanol, resorcinol, hydroquinone, 1,5-dihydroxy naphthaline, etc. Especially preferred are aliphatic diols containing 2 to 8 carbon atoms. Equivalent ester-forming derivatives of diols are also useful (e.g., ethylene oxide or ethylene carbonate can be used in place of ethylene glycol). The term "low molecular weight diols" as used herein should be construed to include such equivalent ester-forming derivatives; provided, however, that the molecular weight requirement pertains to diol only and not to its derivatives.

Dicarboxylic acids which are reacted with the foregoing long-chain glycols (L in formula a) and low molecular weight diols (E in formula b) to produce the copolyesters of this invention are aliphatic, cycloaliphatic, or aromatic dicarboxylic acids of a low molecular weight, i.e., having a molecular weight of less than about 300. The term "dicarboxylic acids" as used herein includes equivalents of carboxylic acids having 2 functional carboxyl groups which perform substantially like dicarboxylic acids in reaction with glycols and diols in forming copolyester polymers. These equivalents include esters and ester-forming derivatives, such as acid halides and anhydrides. The molecular weight requirement pertains to the acid, and not to its equivalent ester of ester-forming derivative. Thus, an ester of a dicarboxylic acid having a molecular weight greater than 300 or an acid equivalent of a dicarboxylic acid having a molecular weight greater than 300 are included, provided the corresponding acid has a molecular weight below about 300. The dicarboxylic acids can contain any substituent groups or combinations which do not substantially interfere with the copolyester polymer formation and use of the polymer of this invention.

Aliphatic dicarboxylic acids, as the term is used herein, refers to the carboxylic acids having 2 carboxyl groups, each attached to a saturated carbon atom. If the carbon atom to which the carboxylic acid group is attached is saturated and is in a ring, the acid is cycloaliphatic. Aliphatic or cycloaliphatic acids having conjugated unsaturation often can be used, provided they are thermally stable at polymerization temperatures and do not undergo homopolymerization.

Aromatic dicarboxylic acids, as the term is used herein, are dicarboxylic acids having 2 carboxyl groups attached to a carbon atom in an isolated or fused benzene ring. It is not necessary that both functional carboxyl groups be attached to the same aromatic ring, and where more than 1 ring is present, they can be joined by aliphatic or aromatic divalent radicals or divalent radicals such as —O— or —$SO_2$—.

Representative aliphatic and cycloaliphatic acids which can be used for this invention are sebacic acid, 1,3-cyclohexane dicarboxylic acid, 1,4-cyclohexane dicarboxylic acid, adipic acid, glutaric acid, succinic acid, carbonic acid, oxalic acid, azelaic acid, dimethylmalonic acid, allylmalonic acid, 4-cyclohexene-1, 2-dicarboxylic acid, 2-ethyl suberic acid, 2,2,3,3-tetramethyl succinic acid, cyclopentane dicarboxylic acid, decahydro-1,5-naphthalene dicarboxylic acid, 4,4'-bicyclohexyl dicarboxylic acid, decahydro-2,6-naphthalene dicarboxylic acid, 4,4'-methylene bis(cyclohexane carboxylic acid), 3,4-furan dicarboxylic acid, and 1,1-cyclobutane dicarboxylic acid. Preferred aliphatic acids are cyclohexanedicarboxylic acids and adipic acid.

Representative aromatic dicarboxylic acids which can be used include terephthalic, phthalic and isophthalic acids, dibenzoic acid, substituted dicarboxylic acids with two benzene nuclei such as Bis(p-carboxyphenyl) methane, p-oxy(p-carboxyphenyl)benzoic acid, ethylene-Bis(p-oxybenzoic acid), 1,5-naphthalene dicarboxylic acid, 2,6-naphthalene dicarboxylic acid, 2,7-naphthalene dicarboxylic acid, phenanthrene dicarboxylic acid, anthracene dicarboxylic acid, 4,4'-sulfonyl dibenzoic acid, and $C_1$–$C_{12}$ alkyl and ring substitution derivatives thereof, such as halo, alkoxy, and aryl derivatives. Hydroxy acids such as ($\beta$-hydroxy ethoxy) benzoic acid can also be used, provided an aromatic dicarboxylic acid is also present.

Aromatic dicarboxylic acids are a preferred class for preparing the copolyester polymers. Among the aromatic acids, those with 8 to 16 carbon atoms are preferred, particularly the phenylene dicarboxylic acids, i.e., terephthalic, phthalic and isophthalic acids.

Polymers described herein can be made conveniently by a conventional ester interchange reaction such as that described in detail in U.S. Pat. No. 3,763,109. Other special polymerization techniques, for example, interfacial polymerization, may prove useful for preparation of specific polymers. Both batch and continuous methods may be used for any stage of copolyester polymer preparation. Polycondensation of prepolymers can also be accomplished in the solid phase by heating divided solid prepolymer in a vacuum or in a stream of inert gas to remove liberated low molecular weight diol. This method has the advantage of reducing degradation, because it must be used at temperatures below the softening point of the prepolymer.

Although the copolyesters possess many desirable properties, it is advisable to stabilize certain of the compositions to heat or ultraviolet radiation, and this can be done by incorporating stabilizers into the polyester compositions. Satisfactory stabilizers comprise phenols and their derivatives, amines and their derivatives, compounds containing both hydroxyl and amine groups, hydroxyazine, oximes, polymeric phenolic esters and salts of multivalent metals in which the metal is in its lower valent state. Particularly useful stabilizers of the preferred segmented co-polyester polyethers are derivatives of 2,2,6,6-tetramethyl piperidine described in pending Johnson et al. application Ser. No. 164,043, filed July 8, 1980.

The properties of these copolyesters can be modified by the incorporation of various conventional inorganic compounds such as titanium dioxide, carbon black, silica gel, alumia, clays, and chopped fiberglass.

A particularly preferred polymer within the above described class is a polymer consisting essentially of about 30% to about 60% by weight of polybutyleneterephthalate units and about 40% to about 70% by weight of hydantoin polyether units and further characterized as above.

Another group of polyester-polyether polymers are the so-called Hytrel type copolyesters which contain a dimethylterephthalate-polytetramethylene ether glycol (molecular weight about 600 to 3000) derived soft segment and a dimethylterephthalate-1,4 butanediol derived hard segment. Preferably, these polymers contain at least about 40% soft segment.

Similar polyethylene terephthalate-polytetramethylene glycol copolymers as well as other polyester-polyether polymers are described in U.S. Pat. Nos. 3,880,976, 3,023,192, 3,651,014 and 3,701,755, which are hereby incorporated by reference.

Urethane based elastomers, assuming that they can be melt extruded to provide sufficient phase separation to display elasticity upon melt extrusion, will display the latent contraction phenomenon of this invention. Likewise, copolyamides, polyamide-polyesters or polyamide-polyethers under the same assumptions will display latent contraction.

Yet another useful polymer group are segmented polyester copolymers, having both polyester hard segments and polyester soft segments. Segmented polymers of this type can be prepared by forming acid chloride terminated hard segments, for example, formed by reacting terephthalic acid chloride with ethylene glycol and then reacting this hard segment with a soft segment polyester, for example, hydroxyl terminated polybutyleneadipate. Preferably, these polyester-polyesters contain at least about 35% soft segment and most preferably at least about 40% soft segment.

The latent contractable filaments of the invention are formed by melt extruding the inherently elastomeric polymer in a conventional manner, preferably to form a filament having a denier of less than about 300, preferably between about 2 and about 250 denier, and most preferably between about 10 and about about 75 denier. It is noted that while deliberate drawing of the filament after extrusion is not practiced (considering drawing to be the extension of a filament between two points to reduce denier and to increase the crystallinity of the filament); with at least some of the polymers employed in the invention, it is observed that a reduction in denier does occur between a time prior to the entry of the filament into the quench bath and the time it arrives on the final package.

The resultant melt extruded filaments at least have a reduced degree of elasticity as compared to the subsequent contracted filament.

The latent contractable, melt extruded filaments are contracted by heat processing at an elevated temperature which is a contraction inducing temperature below the polymer softening temperature generally in the range of about 40°-125° C., preferably between about 80°-100° C. and for a time sufficient to contract the length of the melt extruded filament at least 25% and preferably at least 40% as compared to its precontracted length. Generally, the temperature employed is at least about 15° C. lower than the polymer softening point. The time required for contraction varies with the type of polymer and the temperature. Thirty minutes at 90°-100° C. is generally effective to obtain significant contraction. As most filaments employed in fabric are at some point wet processed, the preferred method of the invention comprises processing the filaments in an aqueous medium at a contraction-inducing temperature of at least about 40°-60° C. for a time sufficient to cause the filament to linearly contract at least about 15%, more preferably at least about 25% and preferably at least about 40% of its original length.

The contractable inherently elastic filaments of the invention are especially useful in a process which generally comprises forming a stretchable textile article which comprises forming a predetermined over-sized article with yarns comprising a latent contractable filament which contracts at least 15% as compared to its original length when exposed to an elevated contraction inducing temperature to provide an elastic filament and exposing the resultant textile article to an elevated temperature sufficient to contract said latent contractable filament at least about 15% to form a stretchable article of desired size. Usually the contractable filament is employed in conjunction with other inelastic yarns and is interspersed unidirectionally or multidirectionally within the textile article.

In a preferred embodiment, the melt extruded filaments, prior to wet processing, are processed into a textile article, either as the sole filament, or most usually intermixed with other fibers, typically in a manner such that the melt extruded latent contractable filament is unidirectionally or biaxially directed and spaced apart within the textile to provide a desired stretch characteristic to the fabric, in a manner generally known in the textile art. However, contrary to the conventional practice, the textile articles of the invention are processed to a relaxed size which is larger than the desired finished end product. The woven, knitted or otherwise processed textile product is then subjected to wet processing at a temperature and for a time sufficient to cause the melt extruded elastomeric polymer to contract and achieve its ultimate desired elasticity. As a result of this contraction, the dimensions of the textile article are reduced, resulting in a textile article having desired dimensions and elastic stretchability.

It is noted that the wet processing step of the invention need not be carried out as a separate step, but can be and most desirably is conducted in conjunction with at least one other aqueous, elevated temperature treatment step such as washing, dyeing, sizing and the like.

The original precontracted dimensions of the textile article can be readily determined based upon the latent contraction characteristic of the particular melt extruded elastomeric polymer employed and the quantity of polymer filaments per unit area, coupled with the heat processing conditions employed. If necessary, a few trials will readily determine the necessary originally woven or knitted textile dimensions required to achieve a heat processed elastically stretchable textile article having the desired finished dimensions.

The heat-processed contracted elastic filaments of the invention have an elastic modulus of at least about 0.01 grams per denier (g/D), preferably between about 0.05 g/D and about 0.5 g/D and most preferably between about 0.2 g/D and about 0.4 g/D, measured at 100% extension. The preferred filaments of the invention are those which have a medium elastic modulus, i.e. between about 0.2 g/D and 0.4 g/D at 100% extension. These filaments provide processed articles which provide relatively high compression and relatively low extension.

Many different textile fabrics and types of garments made therefrom utilizing the contractable elastic filaments of the invention having useful stretch properties are contemplated, including some desirably having relatively high compression forces at low elongation. Some typical uses of stretch fabrics falling within the invention include undergarments, such as hosiery products, girdles, bras and waist bands; outergarments, such as socks, jeans, ski apparel, swimsuits, tube tops, etc.; and elastic bandages. The contractable elastic filaments themselves may be especially useful in certain applications, e.g., elastic string for packaging, and label cords.

The latent-contractable filaments of this invention can be processed into a textile product as extruded. However, in order to protect the filament from abrasion, to provide strength at a maximum extension so that the filament will not be broken, to provide lower running friction and to enhance the appearance and feel of a textile, it is desirable to cover the filaments of the invention with relatively inelastic filaments (i.e., hard fibers) which can be any of the synthetic filaments or fibers commonly used for textile purposes. Elastic yarn covering techniques are known in the art. However, in the prior processes, the elastic yarn was covered in a stretched condition in order to prevent the covering hard fibers from retarding desired extensibility.

In the present invention, the latent-contractable elastic filaments are covered in their melt extruded precontracted state. If desired, the elastic filaments of the invention may be single wrapped with a yarn, i.e., one or more covering yarns being wrapped spirally in a single direction with the elastic filament, or double covered, an additional yarn also being wrapped about the composite yarn with opposite direction of false twist from the first cover yarn. These wrapping procedures are practiced upon the latent-contractable elastic filaments in an essentially unstretched state in a manner such that the wet processed contracted elastic filaments when stretched will be limited in its extensibility by the extensibility of the wrapping hard fiber yarns.

In the preferred assembling process of the invention, the precontraction melt extruded filaments of the invention are comingled with at least one and preferably at least three relatively inelastic filaments (hard fibers) to protect the elastic filament and provide desirable textile properties. The resultant composite yarn upon heat (preferably wet) processing yields a contracted bulky, elastic yarn which is capable of being extended at least 50% and preferably at least 100% of its contracted relaxed length before the relatively inelastic filaments first become load bearing. When stretched until the hard fibers first become load-bearing, the composite yarn is characterized by load-bearing, relatively inelastic filaments entangled with the elastic yarn in intermittent zones of random braided structure and otherwise extending substantially parallel to the elastic yarn, there being an average entanglement spacing of less than 10 centimeters and the filaments being free from crunodal or other surface loops when the composite yarn is examined in the stretched condition.

The composite yarn preferably has substantially zero unidirectional torque. The relatively inelastic filaments preferably have crimp when relaxed. The crimp is preferably such that the relatively inelastic filaments form undulations and twist pigtails when the composite yarn is relaxed. In accordance with a preferred embodiment, the relatively inelastic filaments form reversing helical coils when the composite yarn is relaxed. The relatively inelastic filaments may be bicomponent filaments which crimp when relaxed before or after crimp development.

The composite yarn after latent contraction preferably has a break elongation of 50 to 350 percent or more. Generally, the elastic portion of the composite yarn shows no evidence of crimp, twist or torque produced by the operation of combining the hard fiber filaments with the elastic yarn.

The composite yarn of this invention can be produced at feed rates of up to about 2000 meters per minute, or higher, by continuously feeding the elastic yarn with the relatively inelastic filaments through jetted high velocity fluid and impinging the jetted fluid on the yarn axis at an angle of 90°±45° to entangle the filaments around the elastic yarn in intermittent zones of random braided structure. Usually, the precontraction melt extruded filament is fed to the jetted fluid under predetermined tension sufficient to stretch the filament, if desired, or merely to maintain it relatively taut. The relatively inelastic filaments (hard fibers) are simultaneously fed at a rate which is approximately equal to the rate at which the melt extruded filament is fed or which provides a net overfeed of hard fibers to the jetted fluid. Preferably, the composite yarn is wound on a package under controlled tension.

Suitable hard fiber filaments or fibers include any synthetic textile filaments or fibers of relatively inelastic material such as nylon, e.g., nylon 6 and nylon 6,6; a polyester, e.g., polybutylene terephthalate, and polyethylene terephthalate, polypropylene, cellulose acetate; regenerated cellulose, etc. The hard fiber filaments may be fed to the jetted fluid or a single filament or as a bundle of preferably at least three filaments and may be of more than one material. The bundle preferably has less than ½ turn per inch of twist and the filaments must be capable of being separated by the jetted fluid.

If desired, two or more precontraction melt extruded filaments may be fed and comingled with the inelastic filaments, the plurality of melt extruded filaments being separated at least temporarily by the jetted fluid to, if desired, insert portions of the relatively inelastic filaments between the melt extruded filaments.

The fluid used is preferably compressed air, although other fluids can be used; it is usually at ambient temperature. The fluid is preferably impinged on the yarn from more than one direction, each substantially perpendicular to the yarn axis.

The rate of feed of the inelastic filaments in relation to the precontraction melt extruded filament is determined by the degree of extension desired in composite yarn before the inelastic filaments become load-bearing. For any given filament and intended heat processing conditions, one can determine the amount of contraction to be obtained. Since it is desired that the contracted elastic filament of the invention be extendable at least 50% and preferably between about 100% and 350%, the amount of inelastic filament fed should be that amount which becomes load-bearing at the desired maximum extension of the contracted elastic filament.

Thus, since typically the desired extensibility of the contracted elastic filament is the contracted relaxed length multiplied by about 1.75 to about 6 and, since typically the contracted relaxed length of the heat processed elastic filament is about 40% to about 75% of the precontraction melt extruded filament length, the desired rate of feed of the inelastic filament and the precontraction melt extruded filament can be readily calculated for a given desired composite yarn. For example, if a heat processed elastic filament is contracted 50% based on the starting melt extruded filament and the desired extensibility is 100% (contracted length x2) the rates of feed of the inelastic filaments and the melt extruded filament should be equal. On the other hand, if the desired extensibility of the 50% contracted relaxed elastic filament is 150% (contracted relaxed length x2.5), the rate of feed of the inelastic filaments should be 25% greater than the rate of feed of the melt extruded filament. These calculations assume no extensibility is inherent in the inelastic companion filament. However, where the inelastic companion filament is crimped or otherwise yieldable, obviously the relative feed rates must be adjusted to attain the desired maximum extensibility of the resultant composite yarn.

In order that the relatively inelastic yarn protects the elastic filament from breaking, it is preferable that elastic filament be intermingled with the inelastic yarn in a manner so that the relatively inelastic yarn becomes load-bearing at less than about 95% of the break elongation of the elastic filament.

With reference to FIG. 1, a precontraction melt extruded filament 1 of the invention, from a supply source, is supplied, at a given rate, by driven feed roll 2 to a fluid jet intermingling device 7, while relatively inelastic filaments 3, from a supply source, are supplied at a given rate by rolls 4, 5 and 6, the same as or different from the melt extruded filament supply rate to the fluid jet intermingling device 7. The two filament supplies pass through the fluid jet intermingling device 7, which may have filament guides at the entrance and exit to center the filaments within the jet which intermingles the hard fiber filaments with the melt extruded filament. The resultant composite yarn 8 then passes one or more wraps about roll 9 and then to a windup device and package 10.

Figure 2:
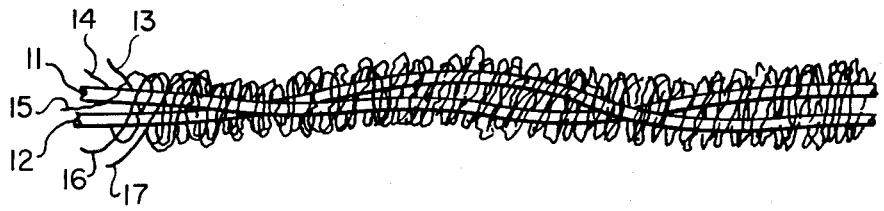
FIG. 2 illustrates a composite yarn obtained by the process of FIG. 1.

With reference to FIG. 2, a useful composite yarn comprises, for example, two heat contracted elastic filaments 11 and 12, intermingled with five inelastic filaments 13, 14, 15, 16 and 17.

The fluid jet intermingling device may be one of those shown in Bunting et al. U.S. Pat. Nos. 3,364,537 and 3,115,691 or McCutchan U.S. Pat. No. 3,426,405, for example, in which one or more fluid streams impinge on the yarn line at an angle of 90°±45°. The essential requirement is that the hard fiber filaments be subjected to a fluid stream having an appreciable component of force at right angles to the filaments to separate them and force them around the inherently elastic yarn and around and between other hard fiber filaments to intermingle the hard fiber filaments by a random braiding action intermittently along the length of the composite yarn. If fluid jets are directed at the yarns at an angle of less than 45°, the fluid forces parallel to the yarns tend to be greater than those transverse to the yarns, thereby tensioning the filaments and tending to form stable loops rather than braiding them. It is also necessary to avoid a predominantly unidirectional fluid twisting vortex, since such action tends to wrap the filaments around the yarn rather than randomly braiding them. Jets having a unidirectional twisting effect are suitable for the present process only when a yarn oscillates rapidly between a region of fluid torque operating in one direction and a region of opposite torque, as in Bunting et al. U.S. Pat. No. 2,990,671.

While in the intermingling process, the melt extruded filament and the inelastic companion filaments can be fed at greatly varying rates relative to each other, because of the subsequent contractability of the melt extruded filament it is not necessary to overfeed the inelastic companion filaments at rates as high as heretofore considered appropriate. Thus, a preferred process comprises continuously feeding at least one of the melt extruded filaments a first predetermined feed rate and relatively inelastic filaments at a second predetermined feed rate through jetted high velocity fluid to entangle the inelastic filament around the melt extruded filament at spaced intervals, the rate of feed of the inelastic filaments being adjusted to the rate of feed of the melt extruded filaments so that the rate of feed of the inelastic filaments is less than twice the rate of feed of the melt extruded filament and is a rate such that after the resultant composite yarn is exposed to an elevated contraction inducing temperature whereby the melt extruded filament is contracted at least about 15% to provide an elastic filament, when the resultant composite yarn is stretched, the inelastic filaments become load-bearing at a predetermined percent of elastic stretching below the break elongation of the elastic filament. That is, to say, the precontraction melt spun filament and inelastic filament are fed at rates adjusted to form a composite yarn which has the desired elastic extensibility properties after the composite yarns has been heat treated to contract the melt spun filament. Because the elastic filament formed by the heat treatment is shortened, the inelastic filament need not be overfed or at least need not be overfed to high rates to achieve the desired elastic extensibility. In any event, upon stretching, it is desired that the inelastic filaments become load bearing before the break elongation of the elastic filament is reached.

The hard fiber multifilaments consist of relatively inelastic continuous filaments of any commonly available textile material. Nylon is generally preferred because of its high strength and low friction. Either uncrimped or crimped yarn may be employed, but crimped or crimpable yarns must be capable of being held loop-free at the tension required to entangle the filament around the core and wind the composite yarn on a package. Tension-stable textured yarn of Breen U.S. Pat. No. 2,783,609, for example, which has crunodal surface loops when held at tension, is unsatisfactory for the purpose of the present invention. Two or more different multifilament yarns may be employed, for example, nylon to give strength at ultimate extension and cellulose acetate to provide luxurious textile aesthetics when the fabric is relaxed. Two yarns having differential shrinkage properties may be employed for certain effects. For example, an untextured polyester yarn having high potential shrinkage may be fed with a textured nylon yarn and be entangled around a melt extruded core yarn wherein both hard fiber yarns are at the same tension during entangling and, in contrast to those of Breen above, remain loop free when wound on the package. When such yarn is made into fabric, and the fabric is heat treated under relaxed conditions, the polyester will shrink while the nylon develops crimp. When the treated fabric is then stretched, the polyester will become the load-bearing member to limit the ultimate extension of the composite yarn and will permit the textured nylon to retain a degree of crimp and bulk even at ultimate extension of the composite.

When the hard fiber component of the present composite yarn is crimped or crimpable, the retractive power of such yarn may be less than that normally required when these filaments are used alone, since the elastic portion of the present composite yarn furnishes the major retractive power of the composite. The hard fiber filaments, therefore, need only have sufficient crimping ability to form the crimps, twists, or coils desired for imparting bulk, opacity or tactile aesthetics to the final fabric. These filaments, therefore, will be processed at higher speeds or under less stringent texturing conditions than would normally be required. This may permit falsetwist texturing, for example, to be performed on hard fiber which is then fed directly into the entangling step in a single continuous process.

There should be at least one and preferably at least three hard fiber filaments. More filaments are generally desirable to provide more chances for intermingling, and more thorough protection for the elastic yarn. Low denier per filament in the hard fiber yarn is generally conducive to better intermingling, the smaller filaments being more easily formed into a random braid. In the case of stretch textured or bicomponent yarns, low denier per filament favors formation of small, fine coils when relaxed. Low bending modulus in the hard fiber filaments is also conducive to improve intermingling.

The hard fiber feed yarns should have low twist, preferably not more than the 0.2 to 0.5 turns per inch known as "producer twist", or most preferably zero twist. High twist interferes with opening of the filament bundle during the process of intermingling and surrounding the elastic core. Feed yarns having zero or low twist may have interlace as described in Bunting et al. U.S. Pat. No. 2,985,995, but they should not have such a large degree of interlace that the filaments are unable to separate for random braiding in the present process. For the present purposes, a yarn having the lowest degree of interlace consistent with processing, winding, and unwinding is preferred, no interlace being most preferable.

The yarns should not have size or finish of such a cohesive nature that it prevents the bundle from opening during the intermingling process although certain finishes may be desirable which allow the bundle to open but aid in retaining intermingling subsequently. Finishes disclosed in Gray U.S. Pat. No. 3,701,248, for example, may be used to improve the performance of yarns of this invention.

Yet another useful process for providing a covered yarn comprises spinning cut or staple fibers about the contractable inherently elastic filament by techniques known in the art as "core spinning". Core spinning is described in U.S. Pat. Nos. 3,380,244; 3,009,311; 3,017,740; and 3,038,295, all of which are incorporated by reference herein, as well as all the references incorporated in those patents. It is noted that while it has generally been considered necessary to stretch the core filament (elastic filament) to provide a useful composite core-spun elastic yarn, in the present invention, if desired, it is not necessary to appreciably stretch the melt extruded filament during the core spinning process. The latent contraction, when heat activated subsequent to core-spinning the relatively inelastic staple fibers about the melt extruded filament, allows subsequent elastic extension of the resultant core-spun yarn before the inelastic yarn becomes load bearing.

There follow a number of Examples which illustrate the invention and what are now considered its best embodiments. As throughout the specification, all parts and percentages are by weight, and all temperatures are degrees Centigrade, unless otherwise specified.

EXAMPLE 1

An ester interchange reactor was charged with 38.9 pounds of dimethylterephthalate, 23.2 pounds of 1,4-butanediol, 66.0 pounds of Dantocol DHE 20, i.e.:

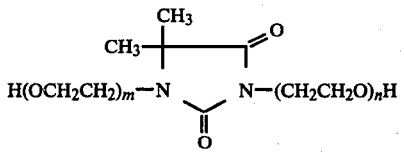

where $m+n=20$, as well as 220 grams of Antioxidant 330, 220 grams of U.V. light stabilizer Tinuvin 770 and 160 grams of titanium dioxide delustrant. The ester interchange reaction was conducted to recover about 12 pounds of methanol. The resultant reaction product was transferred to a polycondensation vessel and the reaction continued to recover about 10.6 pounds of 1,4-butanediol and about 102 pounds of the elastomeric polymer.

Figure 3:
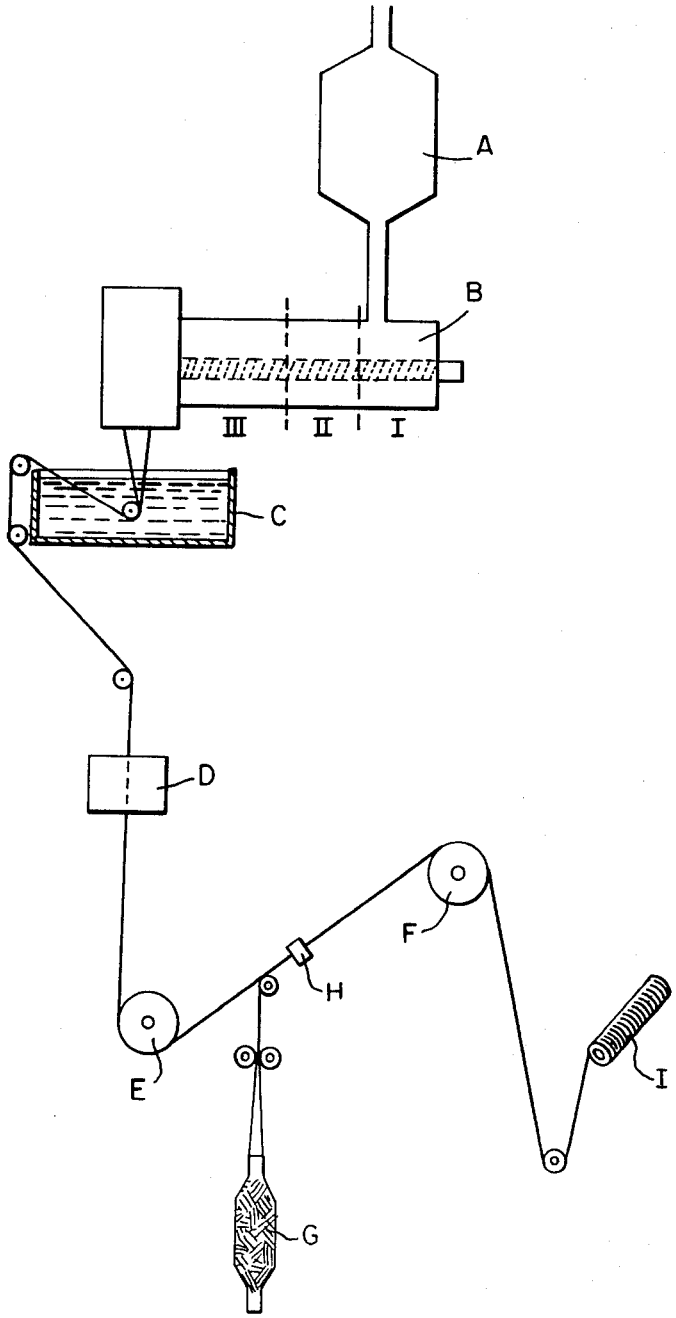
FIG. 3 is a schematic representation of the process employed in Example 1.

With reference to FIG. 3, the above 40 wt% PBT-60 wt% HPOE elastomer in the form of polymer chips stored in bunker (A) were extruded through a ½" extruder (B), the zones I, II and III of the extruder being at temperatures of 215° C., 218° C., and 220° C., respectively. The extruder melt temperature was 205°–207° C. and the pump yield for a 50 denier elastic yarn was 2.0 g/min. The polymer was extruded through a 2-hole spinneret (250μ×400μ) into a water bath (C) which was at room temperature (~22° C.). The water bath temperature was maintained at approximately 20°–22° C. by constant inflow and outflow of water. The distance between the spinneret and the water bath was approximately 5 inches. A standard polyester finish was applied by means of a kiss-roll finish applicator (D). The speed of the two godets (E and F) is 500 meters/min. The elastic yarn was tangled with the companion yarn (G), 20/5 cationic dyeable textured nylon, by feeding both the yarns through a tangling jet (H). The air pressure for tangling used was 60 psi. The combined yarn was wound on a 6" long tube (0.25" thickness) using a Leesona winder (J).

An elastic yarn package containing the combination of the above elastic filament and companion filament in a total denier of 60, which is 40 denier 2 filament (abbreviated as 40/2 elsewhere herein) elastic yarn and 20/5 stretch nylon cationic dyeable companion yarn, was positioned on a horizontal creel of a four-feed high speed (800 RPM) 51 gauge panty hose machine. The elastic yarn was knit in every fourth course of the panty portion at about 3 gram tension. The other 3 feeds knitted a 50 denier stretch nylon cationic dyeable filament yarn. The stitch construction was set on a 1×1 rib.

The band was made in a 3×1 construction of a conventional 560 denier base spandex with a 50 denier cationic dyeable nylon filament, so that the entire panty hose top could be dyed with basic dyes for style purposes. The leg portion, knitted from regular dyeable nylon stretch filament yarn, plain or in combination with regular nylon covered spandex, can be dyed with acid dyes. After knitting, the toes of the hosiery panels were closed and the panty portions were slit to construct the total panty hose panty, while a pre-knitted cotton crotch was sewn in.

The completed panty hose garment was dyed starting with clean hosiery paddle dyeing machines.

Dyeing formulations were added and initial dyeing was run for 10–15 minutes. The bath temperature was raised to 212° F. at a rate of 3° per minute, at which temperature the hose were dyed for 30 to 40 minutes. The latent contraction of the elastic filaments occurred during the dyeing step.

After draining the bath, and gradually cooling the yarn, two 5-minute rinses were given where in the final rinse a 2% softener or finish was added for hand and stretch performance.

Additional samples were made, as above, in which the ratio of hard segments to soft segments were 50:50 and 60:40, respectively. The boiling water contraction of the 50:50 PBT/HPOE was 37%, while that of the 60:40 PBT/HPOE was 17%.

EXAMPLE 2

An ester interchange reactor was charged with 48.6 pounds of dimethylterephthalate, 30 pounds of 1,4-butanediol, 55 pounds of Dantocol DHE 20 and 1.1 pounds of Antioxidant 330. The ester interchange reaction was conducted to recover about 11 pounds of methanol. The resultant reaction product was transferred to a polycondensation vessel and the reaction continued to recover about 6 pounds of 1,4-butanediol and about 96 pounds of elastomeric polymer comprising 50 wt% PBT/50 wt% HPOE in the form of polymer chips. The chips were extruded through a 1" extruder similar to that in Example 1 in which the zones I, II and III of the extruder were at temperatures of 180° C., 190°–200° C., and 200° C., respectively. The extruder melt temperature was 218° C. and the pump yield for a 50 denier elastic yarn was 12.8 g/min. The polymer was extruded through a 6-hole spinneret (250μ×400μ) and quenched in air in a blow box with an air current of 65 cfm. A finish consisting of 50/50 wt% of silicone/varsol was applied by means of a kiss-roll finish applicator and the yarn was tensioned by two godets driven at 1200 meters/min. The latent contraction as determined by hot water shrinkage was 28%.

The elastic yarn, before contraction, can be tangled with a companion yarn, e.g., a 20/5 cationic dyeable textured nylon in the same manner as Example 1, positioned on the horizontal creel of a panty hose machine and knit into the panty portion of a panty hose and finished in the same manner as Example 1. The latent contraction will be exhibited during the dyeing steps.

EXAMPLE 3

Exposing the elastic composite yarn of Example 1 in straight but relaxed condition to dry hot air at 240° F. (115.6° C.) for 30 minutes produced the same yarn contraction as exposing the yarn in straight relaxed condition for 30 minutes in boiling water. As was the case with the boiled-off elastic yarn, the hot air contraction was also completely recoverable.

In addition, the elastic modulus of the elastic filament and the composite yarn of Example 1 were studied. On the linear elongation/load tester, Instron Model 1140 with reversing program possibilities, stress/strain diagrams were made from melt spun elastic yarn with and without companion yarn. Both yarn types were measured before and after boil-off. The yarn in this example was a 50/2 elastic yarn with a 20/5 textured nylon companion yarn. The boiled-off yarn contraction measured 41.1%. The denier of the elastic yarn after boil-off measured 83.

Figure 4:
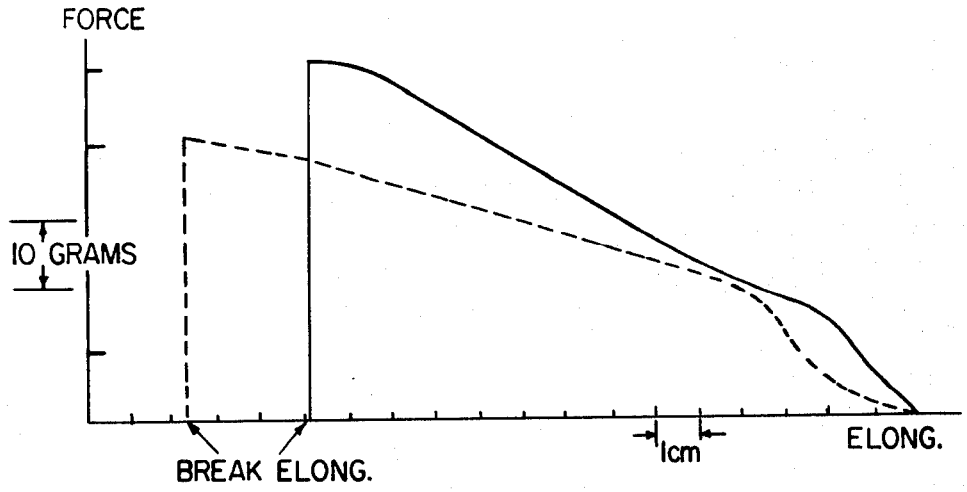
FIGS. 4–6 graph characteristics of a precontracted and heat contracted yarn of the invention as described in Example 1.

In FIG. 4, both the original and boiled-off elastic yarns were elongated to the breaking point. The original 5 cm gauge length for the untreated elastic yarn, the solid line, was reduced to 3 cm, to adjust for contraction of the boiled-off elastic yarn, the dotted line. The diagram shows a reduction in the elastic force for the boiled-off yarn, a reduction in modulus, and a breaking elongation of 560%, which is 2 times the elongation of the untreated elastic yarn of 280%. The crosshead and chart speeds during the measuring were both 50 cm per minute.

Figure 5:
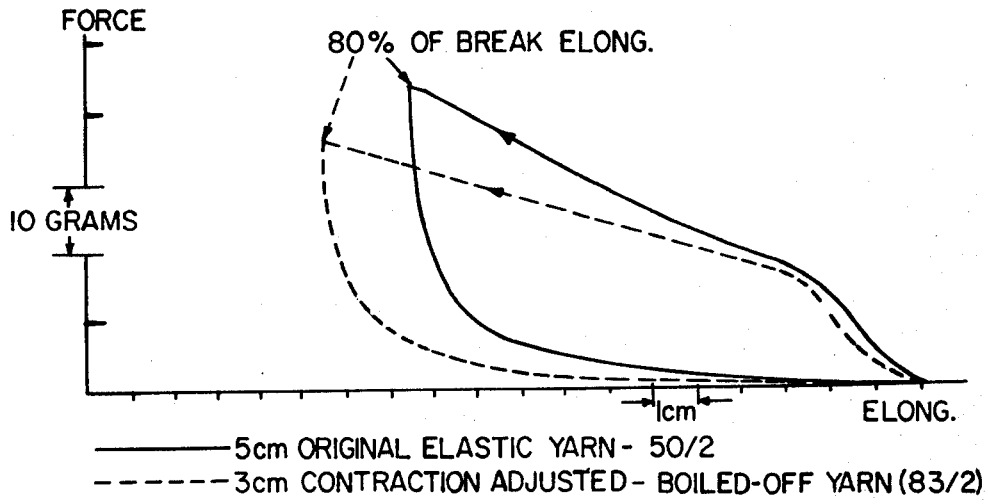

In FIG. 5, the same yarn types were measured under the same conditions as was the case in FIG. 4, with the exception of the setting for maximum elongation. In this example, the Instron was reversed at reaching 80% of the breaking elongation in order to measure the contraction modulus. The chart and crosshead speeds of the return part of the cycle were maintained at 50 cm/minute.

Figure 6:
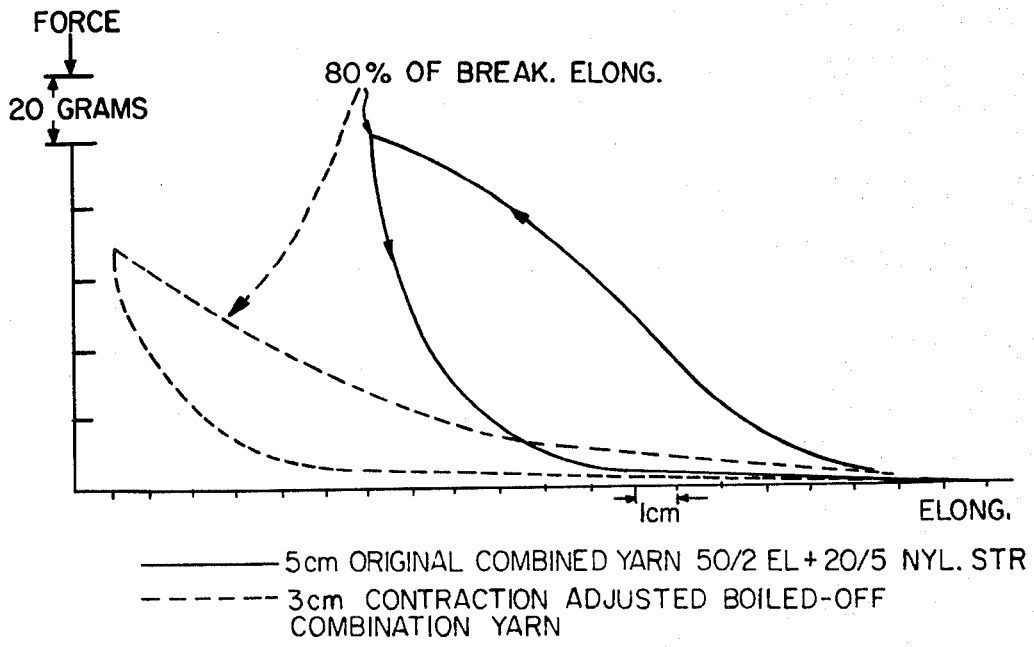

In FIG. 6, the combination of 50/2 elastic yarn with the 20/5 stretch nylon companion yarn was subjected to the stress/strain test. Because of the higher stress forces and the lower elongations of the composite yarn, the full-scale load was doubled and the crosshead speed reduced to 10 cm/minute. One unit (1.5 cm) of the "force" coordinate represents a load of 20 grams, while 3 cms on the "elongation" coordinate equals 20% elongation for the 3-cm sample length of the contraction adjusted boiled-off yarn, the dotted line. For the 5-cm gauge length of the original sample, the solid line, 20% elongation equals 5 cm on the horizontal coordinate. Also, here the chart direction was reversed after reaching 80% of the breaking elongations for the respective samples in order to exhibit the contraction modulus. The diagram of the boiled-off yarn exhibits the typical elastic characteristics of the elastic composite yarn in finished fabrics. Eighty percent of the breaking elongation measures, in this case, 136% stretch at a load of 70 grams. In textile garment applications, the elastic yarn will usually perform in the 60%–100% elongation range and between 10–25 grams elastic force.

EXAMPLE 4

A comparison of elastomeric yarns for contraction after exposure to various fabric processing conditions was made. Three fabric processes were simulated; atmospheric dyeing alone, atmospheric dyeing followed by hot air drying and pressure dyeing. These test exposures were carried out, comparing a 40% polybutylene terephthalate hard segment, 60% hydantoin polyether soft segment segmented copolyester elastomer yarn (PBT/HPOE) prepared in accordance with the aforementioned U.S. Pat. No. 4,262,114 and two non-melt extruded elastomers, Globe Manufacturing 70/1 S5 Lot 525 Glospan spandex, and duPont 70/8 Type 126 Lycra spandex. These three yarns were exposed to the three fabric processing conditions at no extension (relaxed). Exposures were conducted on 25-meter skeins. Length measurements were made using a 20-gram weight for load. The resultant contraction data follow:

| Conditions | Yarn | Contraction (%) |
|---|---|---|
| 97° C./60 min./Wet/Air Dry | PBT/HPOE | 53.6 |
| | Glospan Lot 525 | 7.8 |
| | Lycra Type 126 | 6.8 |
| 97° C./60 min./Wet/Oven Dry 120° C./5 min. | PBT/HPOE | 49.6 |
| | Glospan Lot 525 | 10.5 |
| | Lycra Type 126 | 7.3 |
| 130° C./60 min./Wet (Pressure) | PBT/HPOE | 62.9 |
| | Glospan Lot 525 | 8.9 |
| | Lycra Type 126 | 9.7 |

The primary observation resulting from this data was a confirmation that, when exposed to a boiling water process for one hour, the untensioned PBT/HPOE elastomeric yarn contracts to approximately 50% of its original length. This is in marked contrast to less than 10% contraction for duPont's Lycra. The contraction of elastomeric yarns upon exposure to atmospheric boiling water processes appears to be fully recoverable as stretch—the property most desirable in elastomeric yarns. In order to verify this fact, modified elongation tests were used.

In order to demonstrate that the latent contraction developed under atmospheric dyeing conditions would be fully recoverable as stretch, the yarns exposed to the three fabric processes above were tested for elongation, but under conditions which corrected the developed contraction of the yarns. In simple terms, when a developed specimen was tested in the tensile testing machine, the gauge length was reduced by the percentage which the yarn had contracted. The other machine settings were unaltered. Thus if 1.0" of PBT/HPOE elastomeric yarn would stretch to 2.5" before breaking, and if the developed contraction is fully recoverable, then 0.5" of the developed PBT-HPOE should stretch to a length of 2.5" before breaking. The developed yarn could be said to have twice the elongation of the undeveloped yarns. Or, if the elongations are both reported on the basis of the gauge length used for testing the undeveloped yarn (as is done in the following data table), both undeveloped and developed yarns would be said to have 250% elongation, showing that no total extensibility was lost during contraction:

| Conditions | Yarn | % Elongation - Adjusted for Contraction 0% ext Relaxed Condition |
|---|---|---|
| Control | PBT-HPOE | 250 |
| | Glospan Lot 525 | 870 |
| | Lycra Type 126 | 690 |
| 97° C./60 min./Wet/Air Dry | PBT-HPOE | 250 |
| | Glospan Lot 525 | 890 |
| | Lycra Type 126 | 570 |
| 97° C./60 min./Wet/Oven Dry/120° C./5 min. | PBT-HPOE | 290 |
| | Glospan Lot 525 | 940 |
| | Lycra Type 126 | 630 |
| 130° C./60 min./Wet/Air Dry (Pressure) | PBT-HPOE | 130 |
| | Glospan Lot 525 | 980 |
| | Lycra Type 126 | 790 |

The data in this table demonstrates that the contraction was fully recoverable as stretch.

In addition elongation, breaking strength tests were also conducted, the results of which follow:

| Conditions | Yarn | Breaking Strength (g) 0% Ext Relaxed Condition |
|---|---|---|
| Control | PBT-HPOE | 47 |
| | Glospan Lot 525 | 56 |
| | Lycra Type 126 | 85 |
| 97° C./60 min./Wet/ Air | PBT-HPOE | 40 |
| | Glospan Lot 525 | 62 |
| | Lycra Type 126 | 89 |
| 97° C./60 min./Wet/ Oven Dry 120° C./5 min. | PBT-HPOE | 38 |
| | Glospan Lot 525 | 62 |
| | Lycra Type 126 | 98 |
| 130° C./60 min./Wet/ Air Dry (Pressure) | PBT-HPOE | 17 |
| | Glospan Lot 525 | 44 |
| | Lycra Type 126 | 101 |

EXAMPLE 5

Samples of Hytrel polyether:polyester (polyester hard segments:poly(ethylene terephthalate); polyether soft segments: poly(tetrahydrofuran)) (for preparation, see U.S. Pat. No. 3,763,109) were extruded in the manner generally shown in Example 1 and separate samples of the extruded filament exposed to hot air (80° C.) and boiling water for 30 minutes and the extent of latent contraction measures:

| POLYMER | DENIER | LATENT CONTRACTION (%) HOT AIR | BOILING |
|---|---|---|---|
| Hytrel T-4056 50% hard segment; 50% soft segment | 147 | 30.2 | 30.6 |
| Hytrel T-5556 60% hard segment; 40% soft segment | 94 | 13.4 | 15.2 |
| Hytrel T-6346 80% hard segment; 20% soft segment | 77 | 12.0 | 14.0 |
| Hytrel T-7246 85% hard segment; 15% soft segment | 87 | 9.2 | 10.2 |

EXAMPLE 6

In the general manner of Example 1, a segmented polyether:polyester was prepared consisting of 40% polybutyleneterephthalate hard segment and 60% polyoxyethylene (mol. wt. 1000) soft segment. The polymer was melted extruded into a 40 denier filament using a small laboratory ram extruder. Due to the long residence time inherent in the use of this extruder, a relatively weak fiber was produced having a tenacity (gm/denier) of about 0.2, and an elastic modulus at 100% extension of 0.1 gram/denier. The filament, upon exposure to boiling water for 30 minutes, was an elastic filament which displayed a 33% contraction from its pre heat exposure length.

EXAMPLE 7

A 60% poly(butyleneterephthalate) 40% poly(butylene adipate) polyester:polyester with soft and hard segments formed through urethane links, made in accordance with U.S. patent application Ser. No. 109,180, filed Jan. 2, 1980, was melt spun in a Killian ½-inch extruder at 210° C. through a 1000μ×3000μ spinneret, into water at ambient temperature, and taken up at 300 meter/minutes, to yield a filament having a denier of 73. The filament, upon exposure to boiling water for 30 minutes, displayed a 33% contraction of its original length. The filament prior to heat treatment had an elongation of 213% and after heat treatment had an elongation of 382%.

EXAMPLE 8

Figure 7:
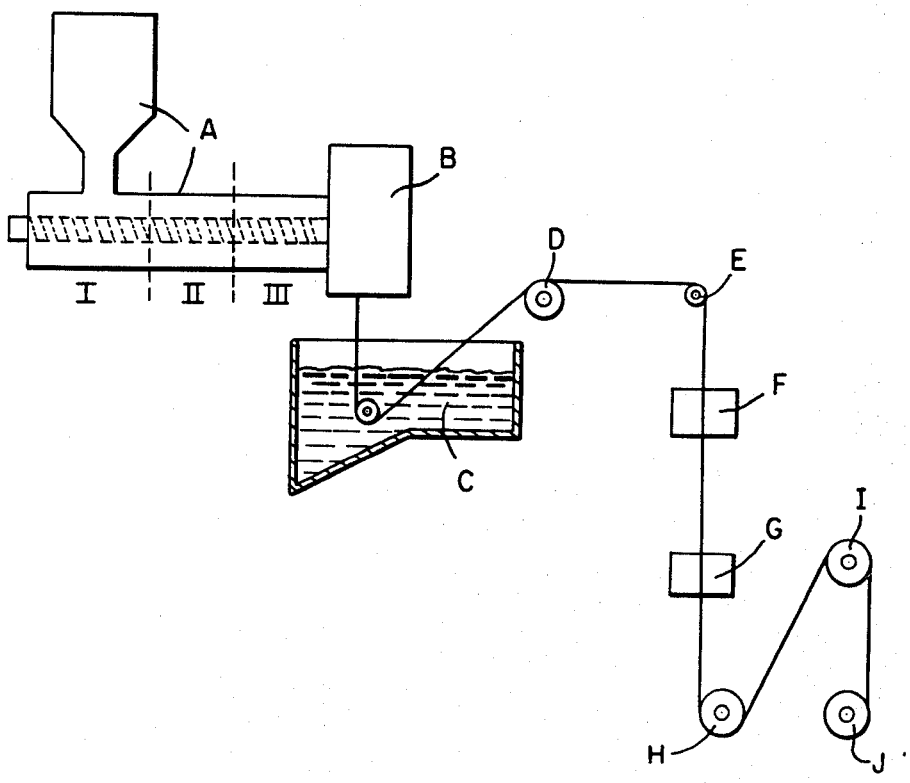
FIG. 7 is a schematic representation of the process employed in Example 7.

With reference to FIG. 7, the 40 weight % PBT-60 weight % HPOE elastomer of Example 1 in the form of polymer chips was extruded through the extruder (A) zone with I, II and III of the extruder being at temperatures of 215° C., 218° C. and 220° C., respectively. The extruder melt temperature was 205°-209° C. and the pump yield for a 42 denier elastic yarn was 2.9 g/min. The polymer was extruded through a single hole spinneret (B) (250μ+400μ) into a water bath (C) which was maintained at room temperature (22° C.). The water bath temperature was maintained at approximately 20°-22° C. by constant inflow and outflow of water. The distance between the spinneret and water bath was approximately 5 inches. The elastic yarn was taken over a haul-off godet (D) running at 850 m/min and over a roller (E). A 25/5 textured nylon yarn was fed to the roller (E) and thereafter both the yarns (elastic and nylon) went through a tangling jet (F). A standard polyester finish was applied by means of a kiss-roll finish applicator (G). The combined yarns passed over two godets (H & I) running at 775 m/min and onto a winder. The combined yarn was would on an 8½"-long tube having a thickness of 0.5" at about 10 gram tension.

The resultant yarn was processed into panty hose in the manner of Example 1.

I claim:

1. A latent contractable melt extruded segmented, inherently elastic polyester-polyester or polyester-polyether thermoplastic polymer filament characterized by containing interspersed relatively hard segments and relatively soft segments, which contracts at least 15% in length when subjected to an elevated temperature, as compared to the length of the melt extruded filament without deliberate drawing prior to contraction to yield an elastic filament.

2. The melt extruded filament of claim 1, said segmented thermoplastic copolyester consisting essentially of a multiplicity of recurring long-chain ester units and short-chain ester units joined head to tail through ester linkages, said long-chain ester units comprising from 40–70% by weight of the copolyester and being represented by the formula:

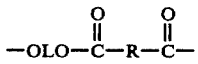

and said shot-chain ester units being represented by the formula:

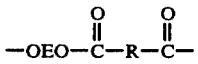

where L in said long-chain unit is a divalent radical remaining after removal of terminal hydroxyl groups from a poly(oxyalkylene) glycol having at lest one thermally stable hydantoin ring per molecule, each of said rings attached to said chain through amide or imide linkages and giving said radical, L, a carbon to nitrogen ratio between about 3/1 and about 350/1, and a number average molecular weight of between 200 and 8,000; R is a divalent radical remaining after removal of carboxyl groups from a dicarboxylic acid having a molecular weight of less than 300; and E in short-chain unit is a divalent radical remaining after removal of hydroxyl groups from a low molecular weight diol having 2 to 15 carbon atoms per molecule and a molecular weight less than about 250.

3. The melt extruded copolyester filament of claim 2, wherein substantially all of the dicarboxylic acid is terephthalic acid and wherein substantially all of the diol having a molecular weight less than about 250 is 1,4-butane diol.

4. The melt extruded copolyester filament of claim 2, wherein —OLO— in said long chain ester unit is a poly(oxyalkylene) glycol unit formed by the oxyalkyation of:

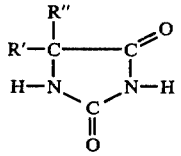

where R′ and R″ are methyl.

5. The melt extruded filament of claims 1, 2, 3, or 4 in the form of a composite yarn wherein the melt extruded filament is intimately associated with inelastic fibers or filaments.

6. The melt extruded filament of claims 1, 2, 3, or 4 which has been contracted at least 15% in length as compared to the length of the melt extruded filament without deliberate drawing by exposure to an elevated temperature above about 80° C to provide an elastic filament.

7. The contracted filament of claim 6 in the form of a composite yarn wherein the melt extruded filament is intimately associated with inelastic fibers or filaments.

8. The melt extruded filament of claim 6 which has been contracted at least 25% in length.

9. The melt extruded filament of claim 6 which has been contracted at least 40% in length.

10. The melt extruded filament of claim 1 which contracts at least about 40% in length when subjected to an elevated temperature as compared to the length of the melt extruded filament prior to contraction.

11. The melt extruded filament of claim 1 incorporating a stabilizer selected from the group consisting of heat stabilizers and ultraviolet radiation stabilizers.

12. A method of forming a latent-contractable elastic filament which comprises melt extruding a polymer as defined in claims 1, 2, 3, or 4 and then without prior deliberate drawing exposing said melt extruded polymer to an elevated temperature above about 80° C. to linearly contract said melt extruded polymer at least 15% to provide an elastic filament.

13. A process which comprises core spinning relatively inelastic fibers about the melt extruded filaments as in claims 1, 2, 3 or 4.

14. A process as in claim 13, where the melt extruded filament is not appreciably stretched during the core-spinning process.

* * * * *